United States Patent [19]

Lumaret et al.

[11] Patent Number: 4,474,626

[45] Date of Patent: Oct. 2, 1984

[54] SOLUTION AND PROCESS FOR THE CHEMICAL CONVERSION OF METAL SUBSTRATES

[75] Inventors: Jean-Claude Lumaret, Bethune; Serge Gossett, Lestrem; Didier Boulinguiez, Bethune, all of France

[73] Assignee: Roquette Freres, Lestrem, France

[21] Appl. No.: 519,318

[22] Filed: Aug. 1, 1983

[30] Foreign Application Priority Data

Aug. 3, 1982 [FR] France ..... 82 13550

[51] Int. Cl.[3] ..... C23F 7/10

[52] U.S. Cl. ..... 148/6.15 Z

[58] Field of Search ..... 148/6.15 Z

[56] References Cited

U.S. PATENT DOCUMENTS 2,067,007 1/1937 Darsey ..... 148/6.15 Z 2,826,517 3/1958 Miller ..... 148/6.15 Z 3,268,367 8/1966 Nelson ..... 148/6.15 Z 4,110,128 8/1978 Dreille ..... 148/6.15 Z

FOREIGN PATENT DOCUMENTS 565717 11/1958 Canada ..... 148/6.15 Z

*Primary Examiner*—Sam Silverberg

*Attorney, Agent, or Firm*—Larson and Taylor

[57] ABSTRACT

Acid solution for the chemical conversion of metallic substrates, comprising:

a polyphosphate, soluble in water and of the formula $(X\,PO_3)_n$ in which $n \geqq 3$ and in which X is an alkali, alkaline earth metal or ammonium, an organic chelating agent and the zinc iron, the pH being brought to the desired value by means of an inorganic acid selected from the group comprising sulphuric hydrochloric and nitric acid.

21 Claims, 6 Drawing Figures

Figure 1:
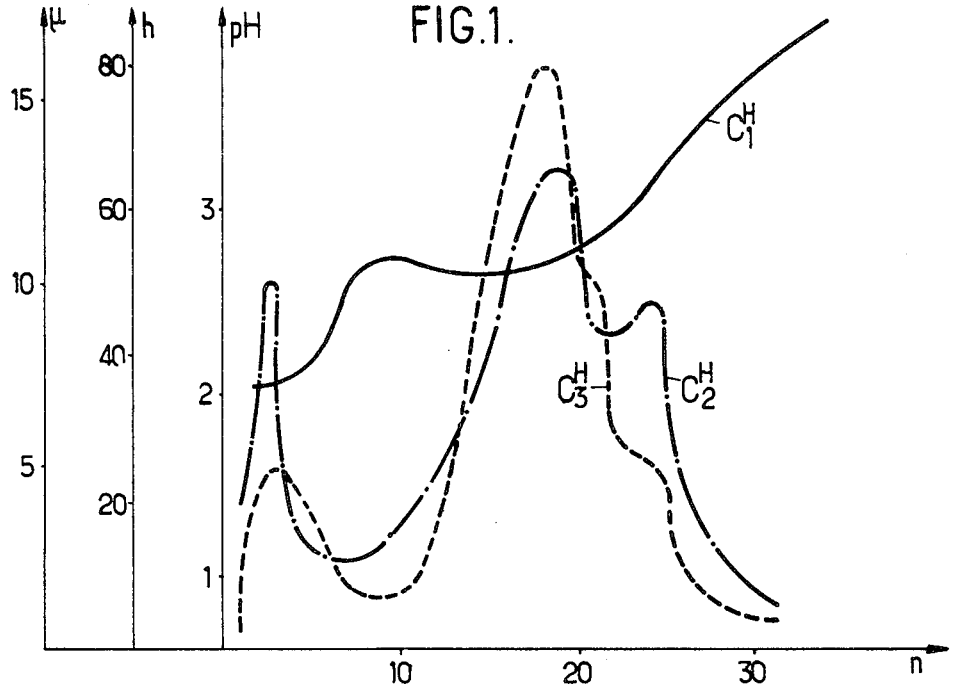

μ
h
pH
15
10
5
80
60
40
20
3
2
1
$C_1^H$
$C_3^H$
$C_2^H$
10
20
30
n

μ
h
pH
30
20
10
150
100
50
4
3
2
$C_1^I$
$C_3^I$
$C_2^I$
10
20
30
n

SOLUTION AND PROCESS FOR THE CHEMICAL CONVERSION OF METAL SUBSTRATES

The invention relates to an aqueous acid solution for the chemical conversion of metal substrates, particularly based on iron or its alloys.

It also relates to a process of chemical conversion using said solution.

It is directed finally to metal parts obtained by employing the conversion process according to the invention.

By the expression "chemical conversion", is meant the surface chemical transformation of metals, particularly in an acid medium, enabling their intrinsic properties to be modified and to confer on them novel physical or physico-chemical characteristics, particularly in order to increase their corrosion resistance and/or to facilitate the adherence of film-forming coatings subsequently applied.

Traditionally, this "chemical conversion" of metal substrates is carried out by conventional phosphatation treatments and leads to the deposition on the surface of the metal of a fine layer of insoluble phosphate.

This phosphatation layer can have a so-called amorphous or crystalline structure.

The amorphous structure is obtained by a conversion based on iron phosphate; the phosphatation layer is then composed essentially of an iron phosphate, vivianite $Fe_3(PO_4)_2$, 8 $H_2O$ and of iron oxide of the magnetite type $Fe_3O_4$. This type of layer enables excellent adherence of paints and an appreciable increase in corrosion resistance.

The crystalline structure is obtained when the processing solution contains, for example, zinc phosphate; the essential constituents of the layer are then hopeite $Zn_3(PO_4)_2$, 4 $H_2O$ and phosphophyllite $Zn_2Fe(PO_4)_2$ 4 $H_2O$ which are in the form of crystals oriented with respect to the support. This type of layer has a certain porosity due to the existence of intercrystalline lacunae, which confer on it good wetting power with respect to products such as paints and varnishes. The essential property of the crystalline layers is however to retard corrosion; this property is related to the dielectric strength of the phosphate coating which resist the passage of local currents generated by the formation of galvanic microcouples at the surface of the metal.

In general, conventional phosphatation treatments employ acid solutions which, before use, contain the following constituents:

- phosphoric acid $H_3PO_4$
- primary metal phosphate $(H_2PO_4)_2Me$, Me often representing zinc or iron, but can also represent manganese, calcium, nickel, copper and the like,
- an accelerator constituted by an oxidizing element generally of mineral origin, selected from among chlorates, nitrates and/or nitrites and associated with one of the previously mentioned metals, or with sodium or ammonium.

These treatments can be carried out by spraying these solutions on the objects to be treated, or, mostly, by dipping the objects to be treated in the solutions, generally at temperatures above 40° C.; the spraying or dipping treatment is inserted as follows in a sequence of operational steps which can comprise:

- a degreasing step,
- a rinsing step (cold, then hot),
- a scouring step for the preparation of the surface to be treated,
- a rinsing step,
- the chemical conversion step proper,
- a washing step for the uncombined acid substances,
- a passivation step in a chromic medium to increase the resistance of the phosphate layer to corrosion,
- a rinsing step,
- a drying and stoving step,
- a "greasing" step (temporary protection) of the layer obtained to the extent that the varnish or paint are not applied immediately.

It has already been proposed to improve in various ways the performance or behaviour of conventional phosphatation baths.

In particular, it has been proposed to add to the above-said solutions an amount, small with respect to the primary phosphate present, of polyphosphates such as, for example, pyrophosphates and long chain polymeric metaphosphates, of the Graham salts type.

This addition to a phosphatation bath of conventional type, that is to say wherein a primary phosphate always appears as essential component, has met with limited interest in spite of the advantages then established, namely:

- low molecular weight of layers obtained which improve adherence to paints and varnishes,
- less consumption to enrichment,
- the reduction of the volume of sludge.

This lack of interest for the polyphosphates is due:

- to the difficulties of controlling the development of the concentration in polyphosphates, of which the presence is not easy to detect and especially
- to the drawbacks resulting from an excess of polyphosphates, for example in pyrophosphate, which excess can rapidly prevent any germination and consequently prevent any formation of a crystalline layer.

It has also been proposed to add "chelating" agents to conventional phosphatation baths having primary phosphates as essential components; these chelating agents were selected from the group comprising EDTA (ethylene-diamine-tetracetic acid), monohydroxycarboxylic acids (particularly gluconic acid) and polycarboxylic acids such as citric acid, oxalic acid, tartaric acid or the like.

This addition of chelating agents or complexing agents was manifested by the following advantages;

- less formation of sludge,
- thicker phosphate deposits, that is to say, contrary to what is observed in the presence of polyphosphates, an increase in the proportion of crystalline deposit occurs.

However, in spite of all these improvements, the solutions or phosphatation baths of the prior art still do not respond to all the requirements of the technique.

In particular, one of the major drawbacks of the conventional phosphatation processes resides in the fact that, even after chromating passivation, the strength of chemical conversion layers obtained and the resistance to corrosion of the treated substrates, are only very limited in time.

Other drawbacks reside in the problems posed for the user:

- through the presence of amounts of phosphate sludge, which, though reduced in certain cases, still remain considerable and are formed during the use of the bath and, through the presence of chrome VI ions, introduced by the passivation step and which constitute toxic and troublesome polluting agents.

Applicant has had the merit of having developed a new solution for chemical conversion responding better than those which already existed to the various exigencies of the technique.

The conversion solution according to the invention has an acid pH and comprises:

a polyphosphate, soluble in water and of formula $(X\ PO_3)_n$ in which $n \leqq 3$ and which X is an alkali or alkaline-earth metal or ammonium, an organic chelating agent and the zinc ion, and the pH can be brought to the desired value by means of a mineral acid selected from the group comprising sulfuric, hydrochloric and nitric acid, nitric acid being preferred by reason of its oxidizing character which favours the initiation of the conversion reaction.

The polyphosphate entering into the constitution of the solution according to the invention can be selected particularly from among sodium trimeta-, tetrameta- and hexametaphosphate, sodium hexametaphosphate or HMPP being preferred.

The chelating agent entering into the constitution of the solution according to the invention may be selected from among:

EDTA (or ethylene-diamine-tetracetic acid),

NTA (or nitrilo-triacetic acid), DTPA (or diethylene-triamine-pentacetic acid), polycarboxylic acids, such as citric, oxalic, malic, glutamic, tartaric, aspartic, glutaric, malonic acid and their salts, polyhydroxycarboxylic acids such as gluconic acid, glucoheptonic acid and their salts, polyhydroxypolycarboxylic acids such as glucaric acid or galactaric acid and their salts.

Glucoheptonic acid and more particularly gluconic acid or their salts are preferred.

The zinc ion can be introduced in any suitable manner and particularly in the form of its salts, such as nitrate or sulfate or its oxide.

The amount of polyphosphate, chelating agents and zinc ion present in the solutions according to the invention are respectively at least 0.2 mmoles, 0.3 mmoles and 0.15 at.-g. per liter.

However, the best results are obtained when the zinc is introduced in the form combined with a chelating agent, preferably in the form of citrate, tartrate, glucoheptonate and, more particularly, gluconate.

A particularly preferredc chemical conversion solution comprises:

sodium hexametaphosphate, zinc gluconate and mineral acid selected from among sulfuric, hydrochloric and nitric acids, nitric acid being preferred by reason of its oxidizing character.

The amounts of polyphosphate and of zinc salts of at least one of the above-said chelating agents present in the solutions according the invention are respectively at least 0.2 mmoles and 0.3 mmoles per liter; in the case of HMPP and of zinc gluconate, these lower limiting amounts are respectively 0.122 and 0.136 g/l.

The top limits of the amounts of polyphosphate of chelating agent and of zinc salt of the chelating agent entering into the constitution of the solution according to the invention do not constitute critical data; theoretically, they are only imposed by the solubility limits; in practise however, the amount of polyphosphate is selected sufficiently low for the amounts of sludge formed not to be troublesome.

Taking into account these considerations, the chemical conversion solution according to the invention comprises 0.25 g/l to 150 g/l of the composition constituted from the polyphosphate and the zinc salt of the chelating agent; preferably, this amount is 2 to 100 g/l and, more preferably still 10 to 80 g/l.

In the case of the above-said preferred solution, the ratio by weight between the zinc gluconate and the sodium hexametaphosphate is comprised between about 10/1 and 1/7, preferably between about 8/1 and $\frac{1}{4}$ and, more preferably still, between about 5/1 and $\frac{1}{3}$.

Still in the case of the above-said preferred solution, the amount of zinc gluconate is 10 to 60 g/l and the amount of hexametaphosphate 2 to 30 g/l.

Still in the case of the above-said preferred solution, the pH of the solution is initially, that is to say before use, brought to a value below 2, preferably comprised between about 0.7 and 1.7.

The chemical conversion process according to the invention is characterised by the fact that it comprises use of the chemical conversion solution according to the invention by spraying onto the metal substrates to be treated or by dipping the substrate in the solution, dipping being preferred.

The use of the conversion solution according to the invention, within the scope of the conversion process according to the invention, is situated in a group of processing steps comprising preferentially:

a degreasing step, a rinsing step, an acid scouring and/or activation step, an optional rinsing step, particularly if the acid bath is constituted by a nitric acid solution, the conversion step proper, a rinsing step, then an optional drying step which is a function of the paint intended to be applied possibly in a subsequent phase.

From comparison with the sequence of steps of the conversion processes of the prior art, it appears that the process according to the invention can be simplified particularly by suppression of the passivation and "greasing" steps.

In fact, the articles treated by the use of the process according to the invention can be stored in the open-air, without any prior protective treatment (for example greasing) and without phenomena of degradation of the layer.

The temperature of the solution is comprised between about 40° and 100° C., more particularly above 60° C. and preferably comprised between 65° and 98° C.

Contact between the solution and the metal substrate is maintained for a time varying, in practice, from 2 seconds to 60 minutes.

When it is the preferred processing solution comprising zinc gluconate and sodium hexametaphosphate which is employed on a metal substrate, it is observed that the value of the pH, initially comprised between about 0.7 and 1.7, increases as a function of the number of objects treated or again of the surface treated, by following a curve which has two characteristic zones similar to plateaux. Most generally, the first of said zones is situated in a pH domain comprised between 1.9 and 2.6 and the second is situated in a pH domain comprised between about 2.2 to 3.5, this depending particularly on the treated surfaces and the treatment prior to the conversion step proper.

It is observed that the articles which are treated when the value of the pH corresponds to one of the zones or plateaux, have particularly advantageous qualities.

It is thus observed, for example, that exceptionally high layer weights could be attained and this under the normal processing conditions. By way of example, layer weights of the order of 40 to 60 g/m$^2$ have been obtained by dipping steel plates in a conversion solution according to the invention for a period of 15 to 25 minutes and at a temperature of 90° C.

Nonetheless, it is possible to indicate that the weight of conversion layer obtained at a pH value corresponding to the first plateau (or layers of the "first zone") is less than that of the layers obtained at the value of pH corresponding to the second plateau (or "second zone" layers). The "second zone" layers have an exceptional corrosion resistance; but even the "first zone" layers have a distinctly superior corrosion resistance than that shown by conversion layers obtained by conventional processes of phosphatation.

This remarkable resistance to corrosion, unknown hitherto, could result from synergy between the polyphosphate and the chelating agent, among which are most particularly gluconic acid. Applicants have been able to observe that in the presence of the conversion solution according to the invention, the rise in the concentration of sodium hexametaphosphate resulted in an increase in the thickness of the conversion layer. Without wishing to be bound by theory, it is thought that, when using the conversion solution, various complexes appear of which the nature is not yet known and which permit the very homogeneous depositions of insoluble salts on the metal surface.

When it is the preferred solution which is employed within the scope of the process according to the invention, the pH of this solution is first of all brought to an initial value of about 0.7 to 1.7 by means of one of the above-said inorganic acids; before its employment proper, the bath is made to ripen particularly by contacting with metallic iron, so as to bring the pH of the solution to a processing value corresponding to one or other of the above-said levels or plateaux, that is to say comprised between 1.9 and 2.6, or between about 2.2 and 3.5.

The choice between one and another of these plateaux is made as a function of the desired quality criteria for the conversion layer.

The pH can be maintained at this plateau if necessary by the addition of sufficient amounts of one of the above-mentioned inorganic acids.

In a preferred embodiment of the process according to the invention, the pH of the chemical conversion solution is developed from the initial value comprised between about 0.7 and 1.7 to a value corresponding to the first and/or the second plateau by adding to the solution a sufficient amount of iron filings, generally from 0.5 to 4 g and, more preferably, from 0.75 to 3 g per liter of solution; the thus "ripened" solution is employed by dipping or spraying.

The presence in the solution of a suitable amount of iron filings, which plays the role of a conversion accelerator, is manifested by a considerable increase in the resistance of the treated objects to the test called "salt fog" test.

The contact time between the bath and the metal object to be treated can be diminished, from a value currently situated between 60 and 30 minutes in the absence of iron filings, to a value of 15 minutes and even 5 minutes.

This accelerator effect of the iron filings can again be increased by the addition of an amount of $H_3PO_4$ which is small and in any case vary much less than the amount of HMPP present in the solution.

Besides the above-mentioned constituents, the conversion solution according to the invention can advantageously comprise:

- wetting agents,
- regenerating agents (amino compounds, boric acid and the like),
- agents improving the conversion at the surface of hollow bodies such as certain automobile bodywork parts (titanium compounds such as, for example, $TiCl_4$),
- conversion accelerating agents other than iron (such as manganese, nickel, copper and the like) introduced in the form of nitrates, nitrites, fluorides, chlorates, sulfides, molybdates or their acids.

Here it is stressed that, among conversion accelerators, manganese nitrate is particularly preferred and enables the speed of crystallisation of the deposit to be improved considerably.

The efficiency of manganese nitrate is illustrated by the fact that processing by means of the solution according to the invention containing $Mn(NO_3)_2$ gives rise to a crystalline swelling or expanding of the deposit, similar to that obtained in the absence of manganese nitrate but in the presence of iron filings and after stoving at 135° C. for 15 minutes. This observation can be made by comparative examination under the scanning electron microscope.

The preferred concentration of manganese is comprised between 0.5 and 1.5 g/l, and more preferably, between 0.75 g/l and 1.25 g/l.

Besides the accelerator effect, the presence of manganese contributes to improve the stabilisation of the pH at the preferred values, which offers, contrary to the phosphatation processes according to the prior art, a distinctly greater reproducibility of the tests.

The exceptional mechanical qualities of the conversion layers obtaied by employing the process according to the invention have been established by mechanical tests of folding on a mandrel which have shown that the layer can undergo considerable deformation without allowing the slightest trace of discontinuity by detachment to appear, and this even for heavy weight layers.

Besides their excellent resistance to attacking media and particularly to salt fog, the conversion layers obtained by employing the process according to the invention constitute an excellent keying base or support for all organic coatings of the glycerophtalic, vinyl, epoxide, polyurethane, water dilutable alkyd, air drying or oven drying type, as well as for metal coatings of the zinc, cadmium, tin type and the like.

These organic or metallic coatings can be applied by brush, by dipping or by air gun or by high pressure gun without air or again electrostatically or also by anodic or cathodic electrodeposition, on the previously produced chemical conversion layers.

In addition, at concentrations and for the preferred above-indicated ratios, the baths obtained by means of conversion solutions according to the invention do not give rise to the formation of the amounts of sludge encountered in prior art baths, thus eliminating pollution problems and guaranteeing excellent stability without renewal, the prior art baths necessitating, for their part, frequent renewals.

Another advantage resides in the fact that the preferred conversion solution according to the invention is essentially based on biodegradable products.

The invention will be still better understood by means of the examples which follow and which relate to advantageous embodiments.

The attached drawings, FIGS. 1–6, are graphs representing the development of the pH; the thickness of the conversion layer (in $\mu$); and the development resistance (in hours) as a function of the number (n) of plates treated with solutions, H, I, J, N, O and R, respectively.

EXAMPLE 1

Comparison between the results obtained, on the one hand, with a solution based on zinc gluconate and sodium hexametaphosphate and, on the other hand, with basic solutions respectively of zinc gluconate alone and sodium hexametaphosphate alone.

To do this, metallic steel test pieces E 24-1 (0.22% of carbon-0.075% of phosphate-0.062% of sulfur) of dimensions approximately equal to 9.5×6.5 cm, having previously undergone cold chemical secouring in a 6 N hydrochloric medium, were dipped for 60 minutes into baths of one liter based on three conversion solutions kept at 95° C. (solutions A, B, C).

Solution A contains 0.25 g/l of zinc gluconate or ZG dihydrate (the concentration is expressed without taking into account the two molecules of water of crystallisation).

Solution B contained 0.25 g/l of sodium hexametaphosphate or HMPP.

Solution C was obtained by mixing equal volumes of solutions A and B.

The pH of each of solutions A, B and C was adjusted to the value of 2, by the addition of some ml of nitric acid.

The effectiveness of the conversion treatment is evaluated visually, the results being presented in table I.

TABLE I

| | VISUAL OBSERVATIONS from the end of the treatment |
|---|---|
| SOLUTION A | Immediate appearance of some rust dots No conversion of the metallic surface. |
| SOLUTION B | Blackish deposit, not adherent, on the plates which oxidized rapidly |
| SOLUTION C | No rust dot Uniform greyish layer - Start of conversion. It seems that the concentration of the bath was poorly adapted. |

These results show that, under the experimental conditions, no conversion took place with zinc gluconate alone or hexametaphosphate alone.

On the contrary, it seems that a start of uniform conversion of the metal surface appears by employing solution C, thus showing a synergy between the two constituents.

A further series of tests was therefore carried out, with increase in concentrations of the composition ZG+HMPP.

EXAMPLE 2

The influence of concentration of the conversion solution in zinc salt of the chelating agent, on the one hand, in polyphosphate, on the other hand.

Sodium hexametaphosphate or HMPP and zinc gluconate or ZG were again used.

For the tests, as in Example 1, the metal steel test pieces E 24-1 of approximately size of 9.5×6.5 cm, having previously undergone cold chemical scouring in a ½ (6 N) hydrochloric medium, were dipped for 60 minutes in a liter of conversion solution, kept at 95° C.

To evaluate the degree of chemical conversion, the various test pieces thus treated were exposed to the attack of a salt fog, obtained by means of a salt fog test apparatus. The conditions of these tests were as follows:

| | |
|---|---|
| Temperature of the enclosure | 35° C. |
| 4.5% NaCl solution | pH 7 |
| Collector surface | 80 $cm^2$ |
| Flow rate | 1.5 l/hour |
| Air | 10.35 $kg/m^3$ |
| humidity of 85 to 95% - pressure = 0.9 bar. | |

Four conversion solutions were tested:

Solution D containing 2.5 g/l of ZG and 2.5 g/l of HMPP

Solution E containing 5 g/l of ZG and 5 g/l of HMPP

Solution F containing 10 g/l of ZG and 10 g/l of HMPP

Solution G containing 22.5 g/l of ZG and 22.5 g/l of HMPP.

The visual observations made at the end of the treatment showed that a uniform layer of greyish tint appeared on all of the treated test pieces and that the intensity of the greyish tint as well as its uniformity increase progressively as the concentration of the baths in ZG+HMPP goes up.

To verify that the intensity of the tint is in relationship with the conversion degree, the treated plates were subjected to the salt fog test for 24 hours.

Before exposure, the edges of these test pieces were protected by means of an adhesive and a V shaped scarification was made at the bottom of the plates.

The results obtained are shown in table II.

TABLE II

| | TESTS WITH SALT FOG VISUAL OBSERVATIONS | |
|---|---|---|
| | At the level of the scarification | At the level of the unscarified surface |
| SOLUTION D | Rusting of all the metal surface (mark 10 on the European rusting scale) | |
| SOLUTION E | Rusting of all the metal surface (mark 10 on the European rusting scale) | |
| SOLUTION F | Rusting | Rust colour of the plate, but no rust dot (no corrosion by puncture) |
| SOLUTION G | Slight rusting. No development of blisters along the scarification | Greyish appearance, practically unchanged with respect to the initial plates. |

It is observed on examining the results collected in table II that a concentration of 45 g/l of the composition in the conversion bath enables excellent protection to be obtained.

The resistance to corrosion of the plates treated with solution G was then tested for several exposure times to salt fog, and was compared with that obtained with the plates treated conventionally, by classical phosphatation with iron and with zinc, available commercially.

The results are shown in table III.

TABLE III

VISUAL OBSERVATION OF THE METAL TEST PIECES

| Reference | Exposure (in hours) | Visual examination at the level of the scarification | Visual examination of the unscarified surface |
|---|---|---|---|
| Plates phosphated with iron | 9 | Total rusting of the metallic surface (mark 10 on the European rusting scale) | |
| Plates phosphated with zinc | 9 | Total rusting of the metallic surface (mark 10 on the European rusting scale) | |
| Plates treated with solution G | 9 | No development of rust outside of the scarification | Greyish appearance, no alteration of the surface |
| | 24<br>48 | No development of blisters or of rust from the scarification | Rust grey appearance no blisters |
| | 72<br>96 | Rusting more pronounced at the level of the scarification no blisters | Appearance of a surface layer of rusty appearance, but no punctures |

It can be noted that the protection obtained by treatment of metal plates with the conversion solution containing 45 g/l of the sodium hexametaphosphate-zinc gluconate composition is quite superior to that obtained by conventional phosphatation, with iron and with zinc. This is all the more remarkable since the plates treated according to the invention had not been subjected to chromate passivation, unlike the phosphated plates according to the prior art.

The concentration of zinc gluconate in the conversion solution remaining fixed at 22.5 g/l, the concentration of sodium hexametaphosphate has been established at different values, in order to determine better its influence on the quality of the conversion.

The experimental method used was as follows:

Steel plates E 24-1, previously chemically scoured, were dipped successively in the conversion bath kept at 95° C., of which the initial pH was brought to a value of 1 by the addition of nitric acid, and containing 1 g/l of iron filings. After a treatment time of 30 minutes, the plates were rinsed and then dried in the open air. The thickness of the conversion layer obtained was then measured by means of a thickness guage of the DIAMETER SM type marketed by the ERICHSEN Company. Then the resistance corrosion was determined as previously, by measurement of behaviour in salt fog.

Correlatively, the pH of the conversion bath was measured after the treatment of each of the plates. To do this, a pH-meter of the 601 A/Digital IONALYSER type, marketed by the ORION RESEARCH Company, provided with a high temperature electrode and calibrated at 95° C. was used.

This enabled the monitoring of the variation in thickness of the conversion layer, the resistance to salt fog and the development of the pH as a function of the number of plates treated.

Three conversion baths were tested, containing respectively:

| | | |
|---|---|---|
| Solution H | ZG | 22.5 g/l |
| | HMPP | 5 g/l |
| Solution I | ZG | 22.5 g/l |
| | HMPP | 10 g/l |
| Solution J | ZG | 22.5 g/l |

-continued

| | | |
|---|---|---|
| | HMPP | 30 g/l. |

Figure 2:
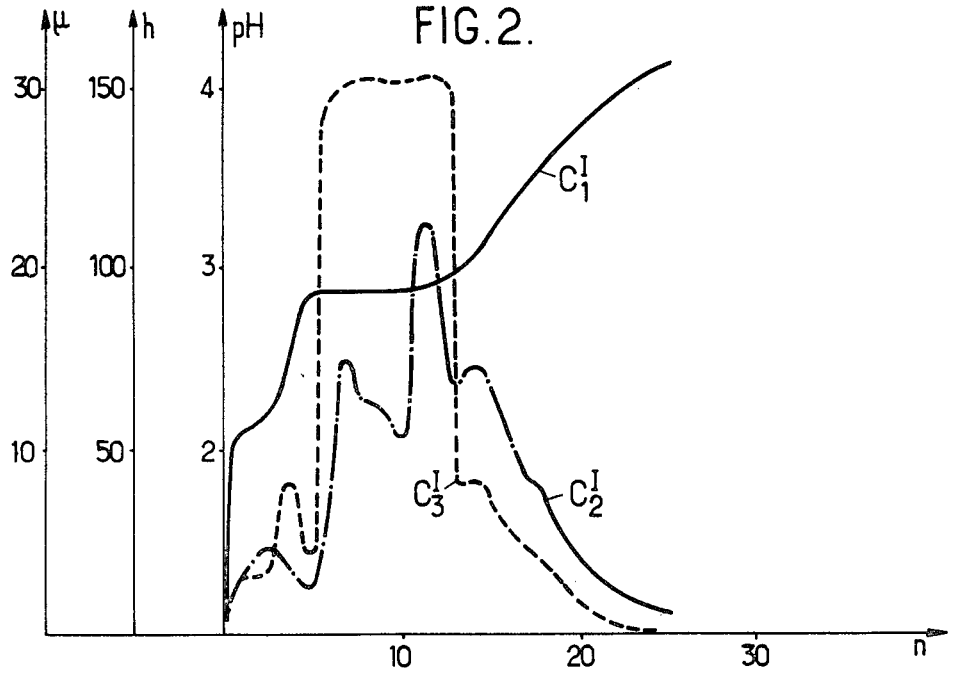
Figure 3:
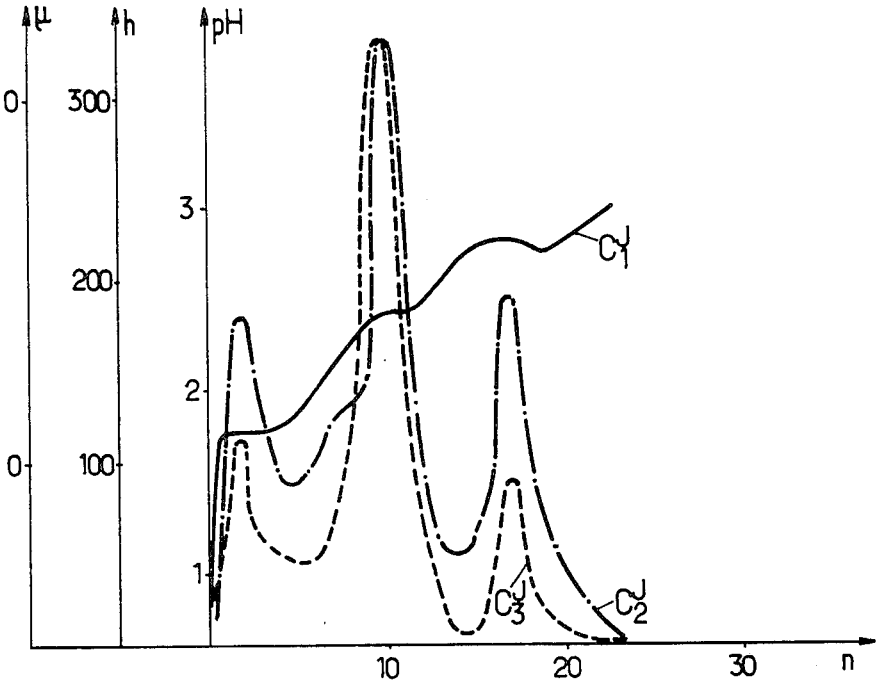

For each of the solutions H, I and J, there is shown respectively on the graphs of FIGS. 1, 2 and 3:

the development of the pH (curves $C_1^H$, $C_1^I$ and $C_1^J$ in FIGS. 1, 2 and 3) as a function of the number n of plates treated, the development of the thickness, in $\mu$, of the conversion layer (curves $C_2^H$, $C_2^I$ and $C_2^J$ in FIGS. 1, 2 and 3) as a function of the number n of plates treated, the development of the resistance, in hours h, in salt fog (curves $C_3^H$, $C_3^I$ and $C_3^J$ in FIGS. 1, 2 and 3) as a function of the number n of plates treated.

On examining the graphs of FIGS. 1, 2 and 3, it is observed that the pH develops progressively with the number of plates treated and that, whatever the concentration selected of HMPP, the most favourable pH zone, if one takes as criterion of choice, resistance to salt fog, seems to be situated under these conditions between 2.5 and 2.9.

It is in fact in this zone (this is the second zone, the first being situated towards pH 2±0.1) that the greatest thickness of the conversion layer is obtained as well as the best resistance to salt fog (which develops also correlatively with respect to one another).

A better resistance to salt fog is observed of the layers corresponding to the second pH zone. However whatever the zone considered, the thickness of the layers and their resistance to the fog increase at the same time as the concentration of HMPP.

Under the best conditions, there are obtained, as is concluded from the curves, the following resistances to salt fog:

| | |
|---|---|
| Solution H | 80 hours |
| Solution I | 150 hours |
| Solution J | 310 hours. |

These values of the resistance to corrosion can be considered as remarkable and no currently known phosphatation enables such performances to be achieved.

However the increase in the concentration of HMPP, if it has a favourable effect on the thickness of the conversion layer and on the resistance to salt fog, is on the other hand troublesome from the point of view of the formation of sludge.

Thus, after exhaustion of each of the baths, if a filtration follows, it is possible to observe an almost total absence of sludge when the concentration of HMPP is 5 g/l, and an amount of sludge of 5 g/l (expressed in dry matter) for a concentration of 10 g/l of HMPP and an amount of sludge of 20 g/l (expressed in dry matter) for a concentration of HMPP of 30 g/l.

The best compromise between the resistance to corrosion and the formation of sludge seems therefore to be realised under these conditions when the concentration of sodium hexametaphosphate is situated between 5 g/l and 10 g/l.

EXAMPLE 3

Comparison between the results of conversion obtained with, on the one hand, a solution based on zinc sulfate and sodium hexametaphosphate and, on the other hand, with a solution based on zinc gluconate and sodium hexametaphosphate.

The experimental method used was identical with that described in Example 2 (influence of the concentration of HMPP), with the exception of the treatment time which was limited to 15 minutes.

The concentration of the conversion solutions was maintained whatever the composition.

In other words, whether it amounts to zinc sulfate or zinc gluconate, concentrations of zinc cations are equivalent.

The concentration of HMPP was unchanged whatever the combination studied.

| | | |
|---|---|---|
| Solution N | Zinc sulfate | 14.4 g/l (7 $H_2O$) |
| | HMPP | 5 g/l |
| | iron | 1 g/l |
| Solution O | Zinc gluconate | 22.5 g/l (7 $H_2O$) |
| | HMPP | 5 g/l |
| | iron | 1 g/l. |

Figure 4:
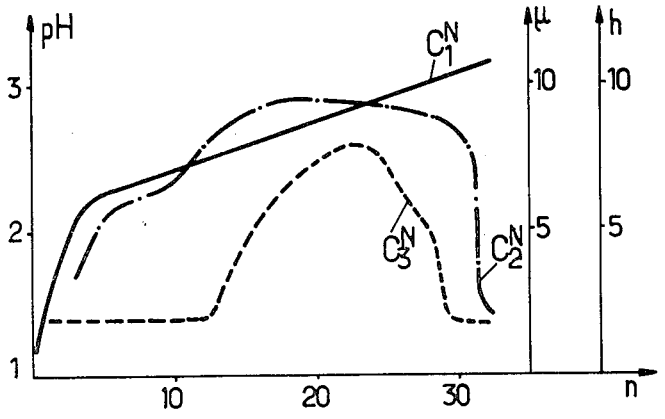
Figure 5:
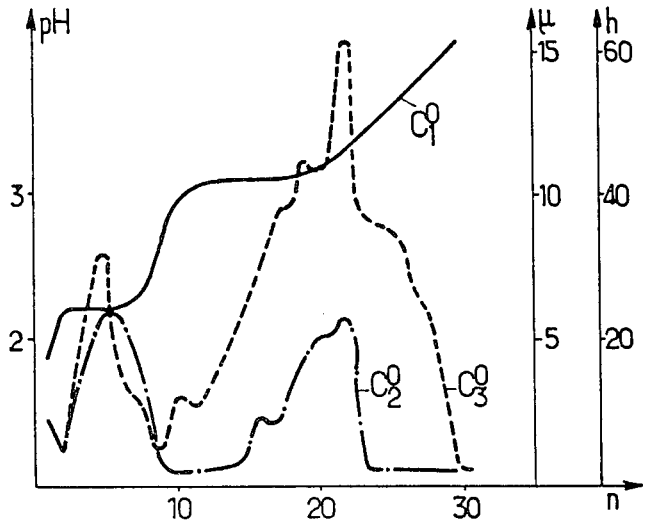

The results were taken up in the curves of FIGS. 4 and 5, namely as in Example 2, which show:

the development of the pH (curves $C_1^N$, $C_1^O$) as a function of the number n of plates treated, the development of the thickness in $\mu$ (curves $C_2^N$ and $C_2^O$) as a function of n and the development of the resistance to corrosion in hours h (curves $C_3^N$ and $C_3^O$) as a function of n.

It appears very clearly, following these tests, that the best composition is indeed that based on zinc gluconate since, if one takes the optimal conditions for the production of satisfactory corrosion resistance, we have:

60 hours in salt fog with solution O and only 8 hours in salt fog with solution N.

On the other hand, it is observed that there do not exist well pronounced pH levels (plateau) when the conversion bath does not contain complexing agent.

EXAMPLE 4

This Example illustrates the use of citric acid as chelating agent.

The experimental method used was identical with that described in Example 3.

The solution tested had the following composition:

| | | |
|---|---|---|
| Solution R | Citric acid | 19.6 g/l |
| | Zinc sulfate | 14.4 g/l (7 $H_2O$) |
| | HMPP | 5 g/l |
| | iron | 1 g/l. |

Figure 6:
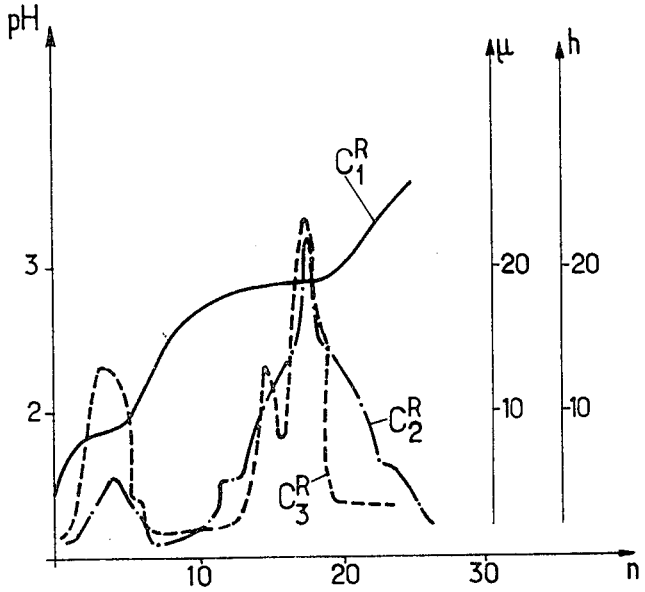

The results are shown by the graphs of FIG. 6, these graphs showing:

the development of the pH (curve $C_1^R$) as a function of the number n of plates treated, the development of the thickness, expressed in $\mu$ (curve $C_2^R$) as a function of n and the development of the resistance to corrosion in hours h (curve $C_3^R$) as a function of n.

Comparison of these results and those obtained with the solution N of Example 3 show the advantage of adding a complexing agent.

EXAMPLE 5

This Example shows also the advantage of introducing zinc ion in the form of the salt of the chelating agent.

The performances are compared, on the one hand, when obtained with a solution based on sodium gluconate plus zinc nitrate in admixture with sodium hexametaphosphate and, on the other hand, when obtained with a solution based on zinc gluconate and sodium hexametaphosphate.

The experimental conditions used are those described in Example 2 with regard to the study of the influence of the concentration of HMPP. The test pieces analysed were those treated at a value of pH corresponding to the second pH zone.

The concentrations of gluconate anions and of zinc cations were equivalent in the two baths studied.

The concentration of the hexametaphosphate was the same in the two cases.

The composition of the two solutions studied was as follows:

| | | |
|---|---|---|
| Solution P | Sodium gluconate (GlNa) | 22 g/l |
| | zinc nitrate $Zn(NO_3)6H_2O$ | 14.5 g/l |
| | HMPP | 5 g/l |
| Solution H (Example 2) | zinc gluconate | 22.5 g/l |
| | HMPP | 5 g/l. |

In table IV there are shown the appearance of the samples after treatment and their resistance to salt fog expressed in hours.

TABLE IV

| Solutions | Appearance | Salt fog (resistance in hours) |
|---|---|---|
| Solution P | Deposit allowing traces of machining to appear | 20 |
| Solution H | Uniform dark grey appearance | 80 |

On examining these results, the advantage of using zinc ion in the form of the salt of the chelating agent is clearly apparent.

EXAMPLE 6

This Example illustrates the advantage of using polyphosphate ion in place of phosphate ion introduced by the sodium dihydrogenphosphate.

The performances obtained are compared, on the one hand, with a composition based on zinc gluconate and sodium dihydrogenphosphate and, on the other hand, with a composition based on zinc gluconate and HMPP in the chemical conversion of test pieces of 9.5×6.5 cm of E 24 - 1 steel.

The operational method was that described above.

The dipping time was 30 minutes.

The pH of the bath was brought successively directly to 2, 2.5 and 3 with nitric acid and iron filings.

The concentration of the two conversion solutions was:

22.5 g/l of ZG 5 g/l of HMPP or of $NaH_2PO_4$.

The results from the point of view of thickness and resistance to salt fog are collected in Table V in which "B.S. (h)" denotes the resistance to salt fog expressed in hours and "Ep ($\mu$)" the thickness of the conversion layer expressed in $\mu$.

TABLE V

| | pH 2 | | pH 2.5 | | pH 3 | |
|---|---|---|---|---|---|---|
| | B.S. (h) | Ep ($\mu$) | B.S. (h) | Ep ($\mu$) | B.S. (h) | Ep ($\mu$) |
| HMPP | 50 | 4.5 | 80 | 5 | 45 | 2 |
| $NaH_2PO_4$ | 20 | 8.5 | 44 | 7 | 20 | 7.5 |

The results obtained with HMPP are distinctly better than those obtained with sodium dihydrogenphosphate from the point of view of behaviour to salt fog and this in spite of the lesser thickness for the conversion layers.

EXAMPLE 7

Advantage resulting from the addition of a conversion accelerator agent paticularly from the point of view of crystallinity of the coating.

1 g/l either of iron filings, or of Mn in the form of Mn nitrate was added to a conversion bath containing 22.5 g/l of zinc gluconate and 5 g/l of sodium hexametaphosphate.

The test pieces were degreased with acetone then with trichlorethylene and then scoured in an aqueous 6 N hydrochloric acid solution for 5 minutes at 40° C.

The treatments were carried out in the same way as in the preceding Examples.

On examination with the electronic scan microscope of two sets of three samples treated respectively in iron and in manganese baths, it is observed that:

in the case of the iron bath, the deposit is more or less crystallized ; the deposit improves the topography but does not entirely mask the support ;

in the case of the bath with manganese, the deposit is much more crystallized than in the case of the preceding bath.

Hence, Mn nitrate, as accelerator, acts more substantially than iron filings on the crystallization of the deposit.

It is noted that, to obtain an identical crystallization with iron, the plates must be stoved for 15 minutes at 130° C.

EXAMPLE 8

It is shown that the conversion treatment of the metal test pieces by a solution based on zinc gluconate and sodium hexametaphosphate does not alter the adherence of the paints, comparatively with the conventional surface treatments of the phosphatation type with zinc or with iron.

The method used consists of measuring the force necessary to tear off a stud of 3.14 $cm^2$ surface area, stuck to a film-forming coating deposited on the surface of a sample.

The measurements are carried out with an Instron type dynamometer.

The film-forming coatings examined were paints of the industrial type, applied in a single layer with an automatic film applicator.

Four sets of samples were selected, respectively:

simply degreased, treated with a solution of ZG and HMPP, treated by conventional phosphatation with zinc, treated by conventional phosphatation with iron.

To these samples various binders were applied, and, after drying, the above-said tear test followed, which gave the force F expressed as kgf for the surface of 3.14 $cm^2$.

The results are assembled in Table VI below, F being the average obtained from 5 successive measurements.

TABLE VI

TEAR-OFF MEASUREMENTS F in kgf for S = 3.14 $cm^2$

| Nature of the binders | Value of F in the tear-off test on samples including the film-forming coating applied after treatment of | | | |
|---|---|---|---|---|
| | degreasing | with ZG + HMPP | Phosphatation with zinc | Phosphatation with iron |
| Linseed oil based glycerophtalic | 22 | 23 | 22 | 25.5 |
| vinyl | 23 | 30 | 20 | 31 |
| acrylic | 14 | 15.5 | 24 | 20 |
| polyurethane | 38 | 20 | 30.5 | 51 |
| epoxy resin | 37 | 52 | 37 | 32.5 |
| water-soluble alkyd | 21 | 16 | 18 | 20 |

Examination of the results collected in Table VI show:

the nature of the chemical conversion does not modify the adherence of the paints of the linseed oil based glycerophtalic type, of the water-soluble alkyd type or of the acrylic type, that there is a reduction in the adherence of the polyurethane type on sheet metal treated with composition ZG+HMPP, in comparison with sheet metal phosphated with iron or with zinc, or simply degreased, that there is an identical behaviour of vinyl paints on metal sheets treated with ZG+HMPP and on metal sheets phosphated with iron, that there is better adhesion of the paints of the epoxy type on metal sheets treated with ZG+HMPP, in comparison with the metal plates phosphated with iron or with zinc.

We claim:

1. Acid solution for the chemical conversion of metallic substrates, comprising:

at least 0.2 m moles per liter of a polyphosphate, soluble in water and of the formula $(X\ PO_3)_n$ in which $n \geqq 3$ and in which X is an alkali, alkaline earth metal or ammonium, at least 0.3 m moles per liter of an organic chelating agent and at least 0.15 of qt.-g the zinc ion, the pH being brought to the desired value by means of an inorganic acid selected from the group comprising sulphuric hydrochloric and nitric acid.

2. Solution according to claim 1, wherein the polyphosphate entering into its constitution is selected from among sodium trimeta-, tetrameta- and hexametaphosphate.

3. Solution according to claim 1, wherein the chelating agent entering into its constitution is selected from among:

EDTA (or ethylene-diamine-tetracetic acid), NTA (or nitrilo-triacetic acid), DTPA (or diethylene-triamine-pentacetic acid), polycarboxylic acids, such as citric, oxalic, malic, glutamic, tartaric, aspartic, glutaric, malonic acid and their salts, polyhydroxycarboxylic acids such as gluconic acid, glucoheptonic acid and their salts, polyhydroxypolycarboxylic acids such as glucaric acid or galataric acid and their salts.

4. Solution according to claim 1, wherein the polyphosphate is sodium hexametaphosphate.

5. Solution according to claim 1, wherein the chelating agent is selected from among hydroxycarboxylic acids.

6. Solution according to claim 1, wherein zinc is introduced in the combined form with the chelating agent.

7. Solution according to claim 1, comprising:
sodium hexametaphosphate,
zinc gluconate and
an inorganic acid selected from among sulphuric, hydrochloric and nitric acid.

8. Solution according to claim 6, comprising from 0.25 to 150 g/l, preferably from 2 to 100 g/l and, more preferably still from 10 to 80 g/l of the composition constituted from the polyphosphate and the zinc salt of the chelating agent.

9. Solution according to claim 7, wherein the ratio by weight between the zinc gluconate and sodium hexametaphosphate is comprised between about 10/1 and 1/7,.

10. Solution according to claim 7, comprising from 10 to 60 g/l of zinc gluconate and from 2 to 30 g/l of sodium hexametaphosphate.

11. Process for the chemical conversion of metal substrates, comprising the employment by spraying or by dipping of the chemical conversion solution according to claim 1.

12. Process according to claim 11, wherein the solution according to claim 7 is employed after having brought its pH initially to a value comprising between about 0.7 and 1.7 and then developing this pH by contacting with metallic iron to a processing value selected between about 1.9 and 2.6,.

13. Process according to claim 12, wherein the contacting with the metallic iron is carried out by the addition of iron filings in an amount of 0.5 to 4 g,.

14. Process according to claim 11, wherein the temperature of the solution as employed is from 40° to 100° C.

15. Process according to claim 11, wherein the contact between the solution and the metal substrate is maintained for 2 seconds to 60 minutes.

16. Solution according to claim 9 wherein the ratio by weight between zinc gluconate and sodium hexametaphosphate is comprised between about 8/1 and 1/4.

17. Solution according to claim 9 wherein the ratio by weight between zine gluconate and sodium hexametaphosphate is comprised between about 5/1 and 1/3.

18. Process according to claim 12 wherein the processing value is selected between about 2.2 and 3.5.

19. Process according to claim 13 wherein contacting with the metallic iron is carried out by the addition of iron filings in an amount of from 0.75 to 3 g per liter of solution.

20. Process according to claim 14 wherein the temperature of the solution is above 60° C.

21. Process according to claim 14 wherein the temperature of the solution is from 65° to 98° C.

* * * * *